US006973883B1

(12) United States Patent
Annamalai et al.

(10) Patent No.: US 6,973,883 B1
(45) Date of Patent: Dec. 13, 2005

(54) REBURN SYSTEM WITH FEEDLOT BIOMASS

(75) Inventors: Kalyan Annamalai, College Station, TX (US); John M. Sweeten, Amarillo, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 10/104,288

(22) Filed: Mar. 22, 2002

Related U.S. Application Data

(60) Provisional application No. 60/278,277, filed on Mar. 22, 2001.

(51) Int. Cl.[7] ..... F23D 1/00; F23C 1/12
(52) U.S. Cl. ..... 110/345; 110/262; 110/347
(58) Field of Search ..... 431/10, 115; 110/342, 110/345, 203, 210, 215, 262, 347

(56) References Cited

U.S. PATENT DOCUMENTS 3,267,891 A * 8/1966 Hemker ..... 8110/28
5,161,471 A * 11/1992 Piekos ..... 110/165 R
5,685,240 A * 11/1997 Briggs et al. ..... 110/106
5,756,059 A * 5/1998 Zamansky et al. ..... 423/239.1
5,937,772 A * 8/1999 Khinkis et al. ..... 110/345
6,357,367 B1 * 3/2002 Breen et al. ..... 110/345
6,453,830 B1 * 9/2002 Zauderer ..... 110/345

OTHER PUBLICATIONS

Department of Energy, *"Reburning Technologies for the Control of Nitrogen Oxides Emissions from Coal-Fired Boilers,"* Clean Coal Technology Topical Report No. 14, pp 1-32.

Stephen Frazzitta et al., *"Performance of a Burner with Coal and Coal-Bio-Solid Fuel Blends, "* Journal of Propulsion and Power vol. 15, No. 2.

H. Liu et al., *"The Significance of Rank on Coal Reburning for the Reduction of No in a Drop-Tube Furnace,"* Transport Phenomena in Combustion vol. 1 cover pages and pp 329-340.

* cited by examiner

*Primary Examiner*—Kenneth Rinehart
(74) *Attorney, Agent, or Firm*—Baker Botts L.L.P.

(57) ABSTRACT

The present invention pertains to the use of feedlot biomass as reburn fuel matter to reduce $NO_x$ emissions. According to one embodiment of the invention, feedlot biomass is used as the reburn fuel to reduce $NO_x$. The invention also includes burners and boiler in which feedlot biomass serves a reburn fuel.

20 Claims, 4 Drawing Sheets

REBURN SYSTEM WITH FEEDLOT BIOMASS

PRIORITY INFORMATION

The present application claims priority under 35 U.S.C. §119(e) to U.S. Provisional Patent Application Ser. No. 60/278,277, filed Mar. 22, 2001 and incorporated by reference herein.

STATEMENT OF GOVERNMENT FUNDING

The present invention has been partially funded by the United States Government through a grant from the U.S. Department of Energy, DOE Grant No. DE-FG26-00NT40810, Contract No. 61980, which may retain certain rights hereto.

TECHNICAL FIELD OF THE INVENTION

The present invention relates generally to the field of reburn systems and, more particularly, to a reburn system with feedlot biomass for increased $NO_x$ reduction in power plants.

BACKGROUND OF THE INVENTION

Acronyms
FB; Feedlot biomass
CAAA: Clean Air Act Amendments
CCT: Clean Coal Technology
DOE: U.S. Department of Energy
FETC: Federal Energy Technology Center
LNB: low $NO_x$ burners
mmBTU: $10^6$ BTU
$NO_x$: Nitrogen Oxides
OFA: overfiered air
SCR: Selective Catalytic Reduction
SNCR: Selective Non-Catalytic Reduction
VOC: volatile organic compounds $NO_x$ is produced when fuel is burned with air. The N in $NO_x$ can come either from the N-containing fuel compounds (e.g., Coal) and the N from air. The $NO_x$ generated from fuel N is called fuel $NO_x$ and that generated from N in air is called thermal $NO_x$. Typically, 75% of $NO_x$ is from fuel N. The $NO_x$ and volatile organic compounds (VOC's; e.g. gasoline vapors from gas station) released from automobiles, utilities, etc. react in the presence of sun light and produce Ozone or Smog (smoke+fog, 0.08 ppm) which can damage cells in the lung's airways, causing inflammation. Thus the $NO_x$, an ingredient for smog, is proposed to be reduced under title IV of CAAA. Table 1 shows the past regulation of $NO_x$ and the proposed new regulations.

TABLE 1

| Coal-Fired Boiler $NO_x$ Emissions Limits (Title IV), ib/million Btu | Phase I | Phase II |
|---|---|---|
| Implementation Date | Jan. 1, 1996 | Jan. 1, 2000 |
| Group I Boilers | | |
| Dry-Bottom, Wall-Fired | 0.50 | 0.46 |
| Tangentially Fired | 0.45 | 0.40 |

TABLE 1-continued

| Coal-Fired Boiler $NO_x$ Emissions Limits (Title IV), ib/million Btu | Phase I | Phase II |
|---|---|---|
| Group II Boilers | | |
| Wet-Bottom, Wall-Fired(>65 MWe) | NA | 0.84 |
| Cyclone-Fired (>155 MWe) | NA | 0.86 |
| Vertically Fired | NA | 0.80 |
| Cell Burner | NA | 0.68 |
| Fluidized Bed | NA | Exempt |
| Stoker | NA | Exempt |

The current technologies developed for reducing $NO_x$ include: Combustion Controls (e.g., staged combustion, low $NO_x$ burners, or reburn technology) and Post Combustion Controls (e.g., Selective Non-Catalytic Reduction, SNCR, etc. using urea). In reburn systems, typically coal or natural gas is injected as an additional fuel downstream of the main burners for reducing the $NO_x$. In SNCR system, Ammonia or urea is injected above the combustion for reducing the $NO_x$. Most current technology uses either coal or natural gas as a reburn fuel coupled with SNCR.

In Frazzitta et al. (Ref. 3), a cofiring experiment using a blend of coal (80%) and cattle manure (feedlot biomass) (20%) is described. Although feedlot biomass contains more N than coal, an increase in $NO_x$ was not observed in the experiment. Therefore, the need exists for further exploration and technological development using feedlot biomass as a fuel.

SUMMARY OF THE INVENTION

The invention includes a method of reducing the amount $NO_x$ resulting from combustion of a main or first fuel. In the method a first fuel is combusted then the products resulting from such fuel combustion is provided to a second combustion under slightly rich conditions. The second combustion is a reburn combustion and the reburn fuel includes up to 100% feedlot biomass by weight. The remaining portion of the reburn fuel may be any other fuel. In one embodiment, it is coal. In an alternate embodiment the reburn fuel is feedlot biomass without any additions of other fuels. The feedlot biomass is generally less than approximately 45% ash and for improved performance is preferably less than approximately 20% ash. In some feedlot biomass, the volatile matter levels are as high as 80%.

The first fuel used in the initial step of the combustion method may be any fuel, but will commonly be coal. The feedlot biomass contains nitrogen in the form of urea/ammonia and in proteins. The combustion may take place in a boiler burner or a multiple-burner boiler unit. If a multiple-burner boiler unit is used, at least one first burner may be used to combust the first fuel and at least one second burner may be used to combust the reburn fuel. In one embodiment, several burners may be used to combust the first fuel before the furnace gases are passed by the reburn burner(s). In another embodiment, burners for the first fuel and reburn burners may be alternated.

The invention also includes a boiler burner for combustion of fuel. The boiler includes a blower which directs air flow. The air is initially directed through a propane burner to which a propane source and an ammonia source are operably connected. This simulates $NO_x$ from a coal-fired burner. Other burners, including burners employing coal or other fuels for a commercial purpose may be used in place of a propane burner. The boiler also includes a reburn fuel injection point past which the air flow is directed after leaving the propane burner and before exiting the exhaust. The reburn fuel used in the boiler burner includes up to 100% feedlot biomass by weight. It may also possess other characteristics described above for feedlot biomass used in the method of the present invention.

The invention additionally includes a multiple-burner boiler unit for combustion. The boiler unit includes a furnace though which furnace gasses flow. The furnace includes at least one first burner which combusts a first fuel and at least one second burner which combusts a reburn fuel. The furnace gases flow from the first burner to the second burner. The reburn fuel includes up to 100% feedlot biomass by weight. It and the first fuel may also possess other characteristics described above for feedlot biomass used in the method of the present invention.

The feedlot biomass reburn system of the present invention combines the advantages of SNCR along with reburn systems since the feedlot biomass naturally contains urea/ammonia along with a large amount of volatile materials. Other technical advantages will be readily apparent to one skilled in the art.

BRIEF DESCRIPTION OF THE DRAWINGS

For a more complete understanding of the present invention, and for further features and advantages thereof, reference is now made to the following description taken in conjunction with the accompanying drawings, in which.

DETAILED DESCRIPTION OF THE INVENTION

Figure 1:
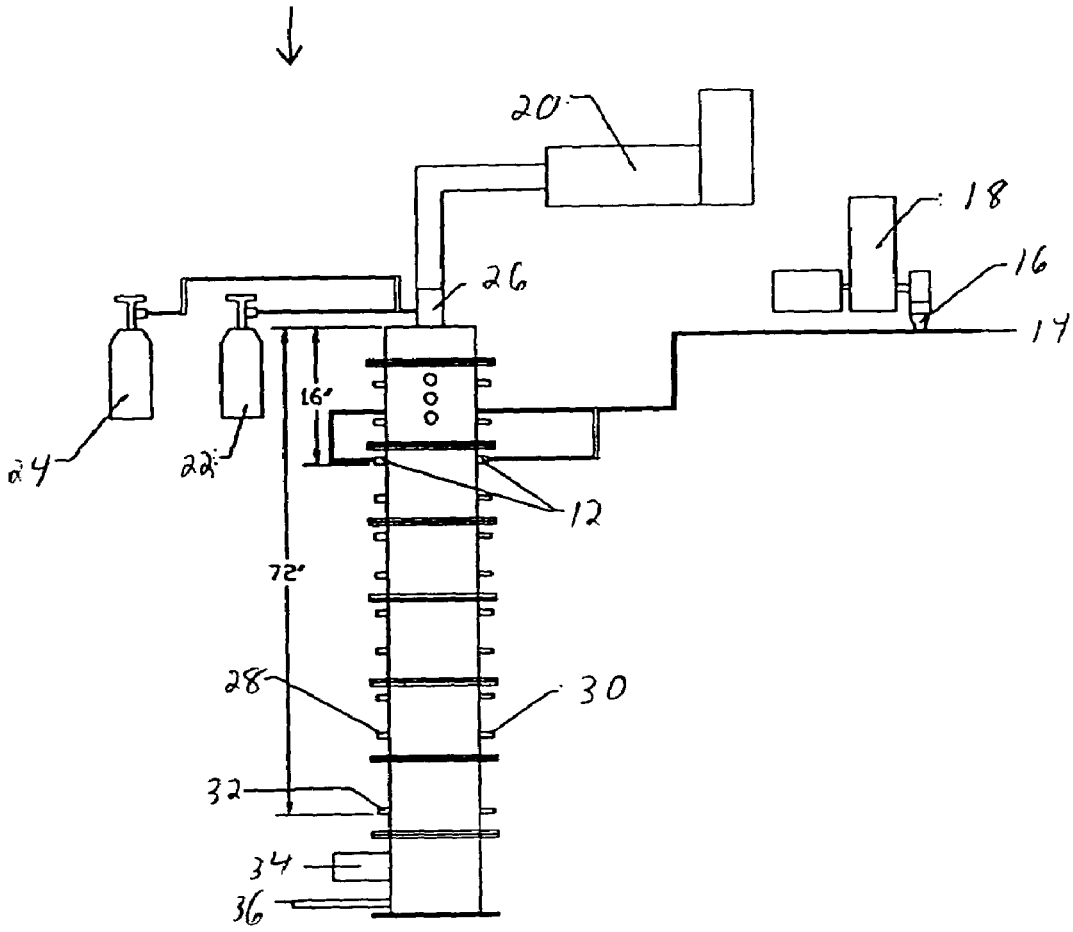
FIG. 1 is a diagram illustrating a reburn system with feedlot biomass as reburn fuel in accordance with an embodiment of the present invention.
Figure 2A:
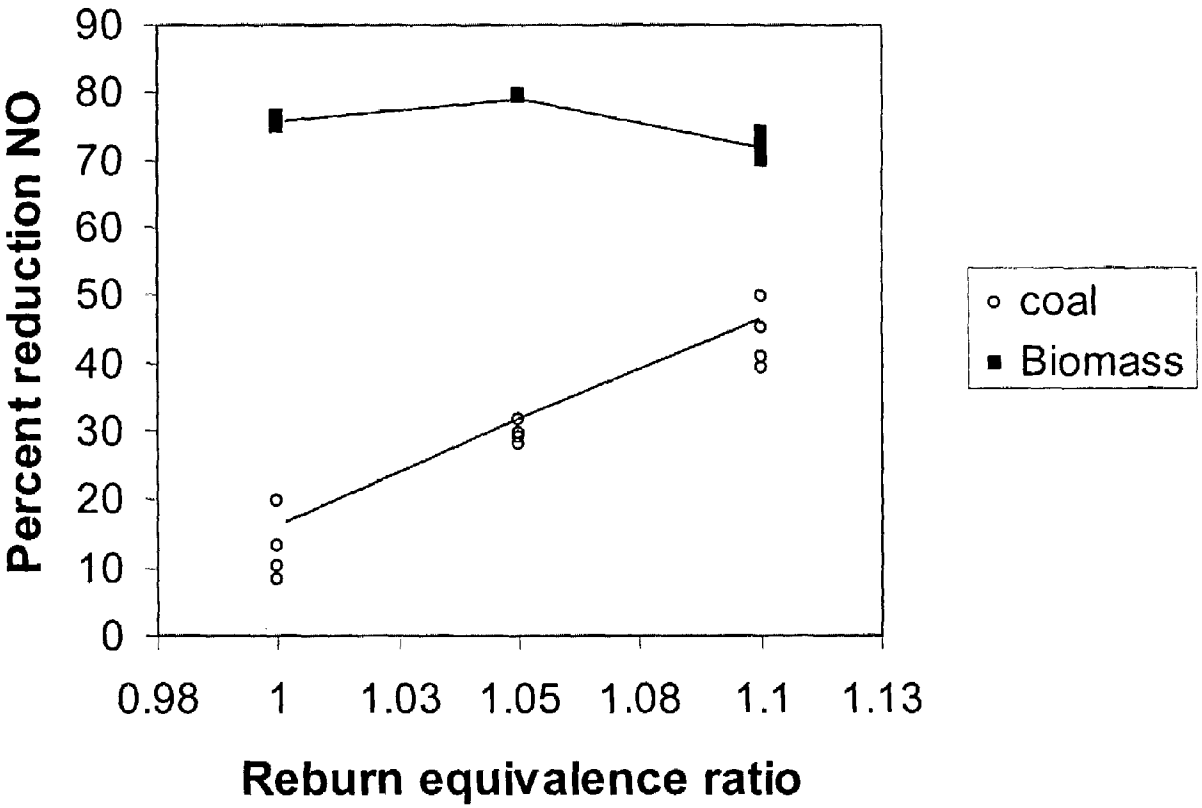
FIG. 2*a* is a diagram illustrating a comparison of =data obtained with feedlot biomass and coal as reburn fuels in an embodiment of the present invention.
Figure 2B:
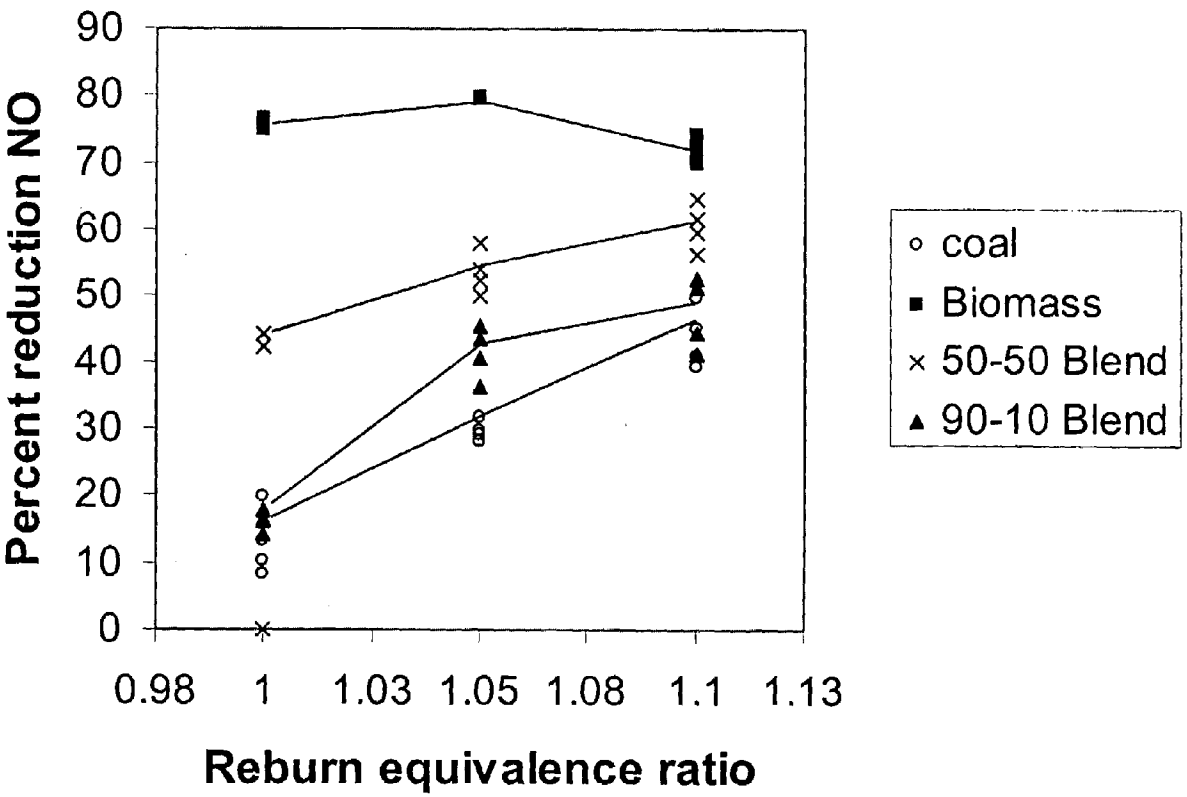
FIG. 2*b* is a diagram illustrating a comparison of data obtained with feedlot biomass, coal and mixtures thereof as reburn fuels in an embodiment of the present invention.
Figure 3:
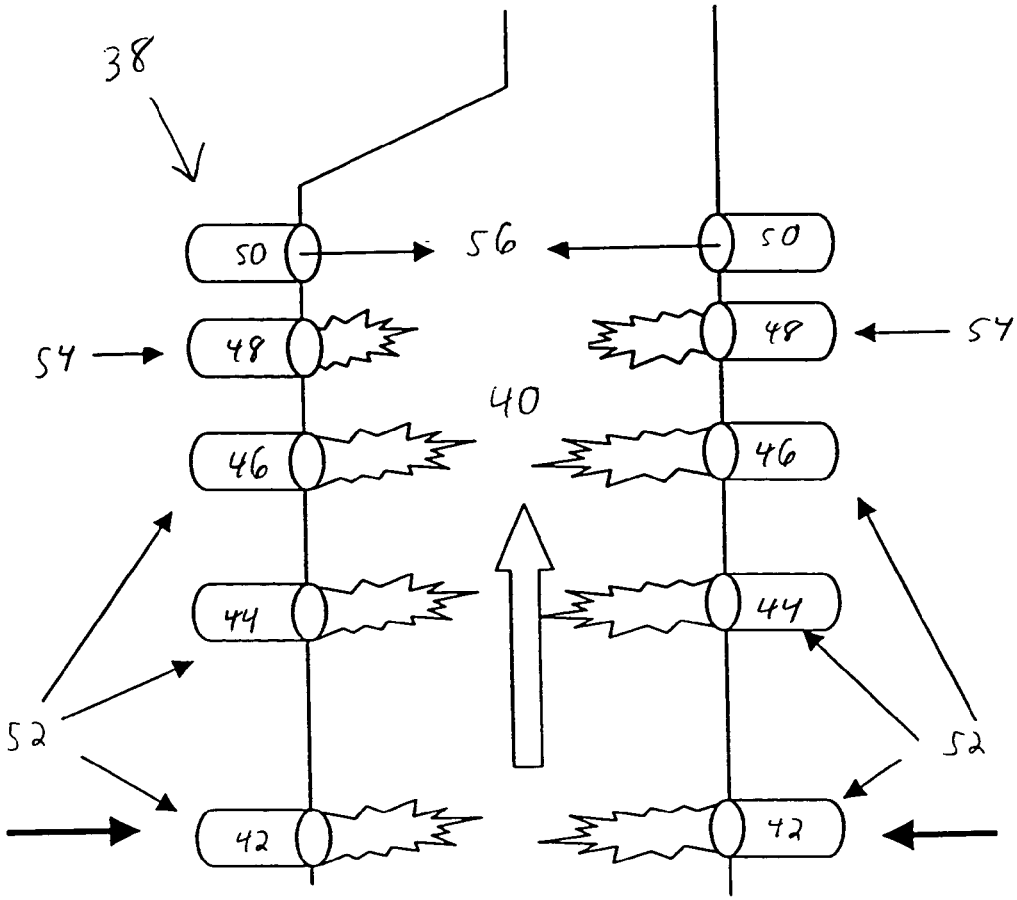
FIG. 3 is a diagram illustrating a boiler burner with feedlot biomass reburner in accordance with an embodiment of the present invention.

Preferred embodiments of the present invention and their advantages are best understood by reference to FIGS. 1 through 3, where like numbers are used to indicate like and corresponding features.

Referring to FIG. 1, a reburn system 10 may be used to burn feedlot biomass. Feedlot biomass enters reburn system 10 at reburn fuel injection point 12. Shop air enters reburn system 10 at input 14 and passes through venturi 16 which is operably connected to fuel hopper 18 prior to passing through reburn fuel injection point 12. Air flow through reburn system 10 is maintained by blower 20. Propane and ammonia from propane source 22 and ammonia source 24 are injected into the air flow at propane burner 26, (in order to simulate $NO_x$ production from a coal-fired burner) which is located prior to reburn fuel injection point 12 in the air flow. Sampling port 28 and thermocouple port 30 are located downstream in the air flow from reburn fuel injection port 12 to allow monitoring of various qualities, including $NO_x$ levels and combustion-related data. Cooling spray 32 is provided to the air flow prior to its exit from exhaust 34. Cooling water exits from outlet 36. The above reburn system is suitable for experimental purposes. It may be used or adapted for industrial purposes as well, for instance by replacing the propane burner with a coal-fired or other burner.

In an exemplary embodiment, the boiler of FIG. 1 is a 30 kw (100,000 BTU/hr) burner. It has a reburn fuel percentage of 30% and a primary equivalence ratio of 0.96. The initial NO concentration is approximately 600 ppm and the reburn injection velocity is 10–16 m/s. The primary air flow rate is approximately 800 SCFH. The reburn equivalence ratio is 1-1.1.

Referring to FIG. 2, analysis of a reburn system such as that of FIG. 1 using various sources of reburn fuel indicates that feedlot biomass (manure) alone as a reburn fuel provides significant reduction in NO as compared to coal alone. (See FIGS. 2*a* and *b*.) Some improvements are also seen with a 50/50 blend of manure and coal and a 90/10 blend of manure and coal. (See FIG. 2*b*.) Overall, a 70–80% reduction in $NO_x$ is achieved through the use of feedlot biomass as a reburn fuel. This is nearly double the reduction achieved with coal alone. Furthermore, this result is independent of stiochiometry.

Referring to FIG. 3, multi-burner boiler unit 38 may use feedlot biomass 54 as a reburn fuel. Coal 52 is provided to initial burners 42, second burners 44 and third burners 46 in gas furnace 40. Feedlot biomass 54 is provided to penultimate burners 48. Final burners 50 provide overfire air 56 to complete combustion.

One skilled in the art will appreciate that any number of earlier coal burners may be used in multi-boiler unit 38, so long as penultimate burners 48 are supplied with feedlot biomass 54 with a richer stoichiometry and the final burners 50 are used to complete combustion. In an alternative embodiment of a multi-burner boiler, feedlot biomass may be mixed with coal and used in alternating burners but with reduced secondary air in those burners. A final reburn burner may also be included in this assembly.

For a more detailed understanding of the invention, reference may be had to the following examples, which are provided for illustrative purposes and do not encompass or represent the entire scope of the invention. Variations of the examples and other embodiments of the present invention will be apparent to one skilled in the art.

EXAMPLE 1

Recent test results relating to the present invention were obtained in the 30 kW (100,000 BTU/hr) Boiler Burner Laboratory, located in the Department of Mechanical Engineering. While power plants currently use coal or expensive and non-renewable natural gas to reduce $NO_x$ by 50–60%, the test results using cheaper, renewable feedlot biomass indicate a 70–80% reduction in $NO_x$. This is likely due to the unusual combination of urea/ammonia and the higher volatile material levels in feedlot biomass.

In order to validate the beneficial combination of feedlot biomass, a boiler burner facility (heat thruput: 100,000 BTU/hr) along with reburn system has been built as shown in FIG. 1. Experimental data using the reburn system of FIG. 1 with high ash feedlot biomass (about 45% ash) is shown in FIG. 2. The data set is the first ever obtained with high ash feedlot biomass as reburn fuel; the experimental data shown in FIG. 2 clearly illustrates that 70–80% reduction in $NO_x$ has been achieved and is almost double that of coal as reburn fuel. None of the existing data cited in Ref. 1 and briefly summarized in Table 2 reports such a reduction. The column labeled "% Reburn Heat Input" represents the percentage of heat input from reburn fuel. The column labeled "1% Reduction" represents the percentage of $NO_x$ reduction achieved with each system.

TABLE 2

% Reduction in $NO_x$: Demonstration and/or Operating Reburn Installations on Coal-Fired Boilers in the United States [1]

| # | Type of Burner | % Reburn Heat Input | % Reduction | $NO_x$ with Reburn Lb/mmBTU |
|---|---|---|---|---|
| 1 | Gas Reburning | | | |
| | Tangential | 18 | 50–67 | 0.25 |
| | Cyclone | 20–23 | 58–60 | 0.39–0.56 |
| | Wall without LNB | 18 | 63 | 0.27 |
| 2 | Coal Reburn | | | |
| | Cyclone (micronized) | 30 (17) | 52 (57) | 0.39 (0.59) |
| | Tangential (micron) w/LNB | 14 | 28 | 0.25 |

The feedlot biomass used to obtain the results depicted in FIG. 2 contains approximately 45% ash. Improved results may be obtained using feedlot biomass with lower ash content, preferably less than approximately 20% ash. Lower ash biomass contains higher VOC levels. Adjustment to the reburn system to reflect the ash content of the feedlot biomass may be made in a manner similar to adjustments made for variations in ash content of coal or other reburn fuel sources.

Additional characteristics of the fuels used to obtain the results shown in FIG. 2 are summarized in Table 3.

TABLE 3

| | Fuel Properties | | | |
|---|---|---|---|---|
| | Coal | FB | 50:50 | 90:10 |
| C | 60.3 | 23.6 | 39.0 | 56.6 |
| H | 3.62 | 2.9 | 3.5 | 3.5 |
| O | 14.5 | 19.0 | 16.7 | 14.9 |
| N | 0.96 | 1.78 | 1.555 | 1.04 |
| S | 0.23 | 0.71 | 0.6425 | 0.278 |
| Dry loss | 15.12 | 7.735 | 14.8 | 14.3 |
| FC | 42.38 | 6.67 | 24.5 | 38.8 |
| VM | 37.17 | 41.43 | 39.3 | 37.6 |
| Ash | 5.33 | 44.2 | 23.9 | 9.21 |
| HHV (kJ/kg) | 23709.8 | 9421.9 | 15473 | 22281 |

FB = Feedlot Biomass,
50:50 = 50% by weight coal, 50% by weight feedlot biomass;
90:10 = 90% by weight coal, 10% by weight feedlot biomass;
FC = Fixed Carbon;
VM = Volatile Matter(% dry weight);
HHV = Higher Heating Value.

Feedlot biomass is used herein to designate and includes a variety of animal-based wastes. It may include but is not limited to primarily manure biomass from beef, swine, horses, or poultry (such as chickens or turkeys), preferably from an area where animals are confined and are fed. The feedlot biomass may be raw (fresh) manure, partially composted manure, finished composted manure, or stockpiled manure.

Feedlot biomass may be supplied to the burner (whether in a multiple-burner unit or not) in any form suitable for use in the selected equipment. In some embodiments of the present invention, the feedlot biomass is provided in the form of a fine powder. Variation in water content and particle size may be necessary to achieve optimal results. Such variations will be apparent or readily determined without undue experimentation based upon current knowledge regarding the use of coal and other fuels as reburn fuels and in boiler burner systems. Burner operating parameters may also be adjusted to accommodate variations in the fuel.

EXAMPLE 2

Additional experiments with various feedlot biomass sources and mixtures are summarized in Tables 4–26.

TABLE 4

| | | | |
|---|---|---|---|
| | | Fuel | 50:50 |
| Total Rating kW | 100 | Fuel Rate | 49.5 |
| Reburn % | 30 | Fuel Setting | 24.23 |
| Primary ϕ | 1 | Primary Air $O_2$ % | .96 |
| Reburn ϕ | 1.1 (.28) | Reburn Air $O_2$ % | 4.3 |

| # | NO Before | $O_2$ Before | NO Reburn | $O_2$ Reburn |
|---|---|---|---|---|
| 1. | 596 | 4.3 | 350 | 0 |
| 2. | 597 | 4.3 | 332 | 0 |
| 3. | 599 | 4.3 | 290 | 0 |
| 4. | 588 | 4.3 | 277 | 0 |

TABLE 5

| | | | |
|---|---|---|---|
| | | Fuel | Coal |
| Total Rating kW | 100 | Fuel Rate | 22.77 |
| Reburn % | 30 | Fuel Setting | 39.52 |
| Primary ϕ | .95 | Primary Air $O_2$ % | .96 |
| Reburn ϕ | 1.1 | Reburn Air $O_2$ % | 4.2 |
| Primary Air | 803 | | |
| Reburn Air | 171 | | |

| # | NO Before | $O_2$ Before | NO Reburn | $O_2$ Reburn | NO After | $O_2$ After |
|---|---|---|---|---|---|---|
| 1. | 585 | 4.3 | 356 | 0 | 563 | 4.1 |
| 2. | 603 | 4.3 | 357 | 0 | 597 | 4.1 |
| 3. | 597 | 4.1 | 327 | 0 | 573 | 4.0 |
| 4. | 590 | 4.2 | 297 | 0 | | |

TABLE 6

| | | | |
|---|---|---|---|
| | | Fuel | Coal |
| Total Rating kW | 100 | Fuel Rate | 22.77 |
| Reburn % | 30 | Fuel Setting | 39.52 |
| Primary ϕ | .95 | Primary Air $O_2$ % | .96 |
| Reburn ϕ | 1.05 | Reburn Air $O_2$ % | 5.0 |
| Primary Air | 803 | | |
| Reburn Air | 217 | | |

| # | NO Before | $O_2$ Before | NO Reburn | $O_2$ Reburn | NO After | $O_2$ After |
|---|---|---|---|---|---|---|
| 1. | 604 | 4.9 | 428 | 0 | 560 | 5.2 |
| 2. | 584 | 4.9 | 421 | 0 | | |
| 3. | 622 | 5.0 | 438 | 0 | | |
| 4. | 622 | 5.1 | 425 | 0 | | |

TABLE 7

| | | | |
|---|---|---|---|
| | | Fuel | Coal |
| Total Rating kW | 100 | Fuel Rate | 22.77 |
| Reburn % | 30 | Fuel Setting | 39.52 |
| Primary ϕ | .95 | Primary Air $O_2$ % | .96 |
| Reburn ϕ | 1 (40%) | Reburn Air $O_2$ % | 5.6 |
| Primary Air | 803 | | |
| Reburn Air | 268 | | |

TABLE 7-continued

| # | NO Before | $O_2$ Before | NO Reburn | $O_2$ Reburn |
|---|---|---|---|---|
| 1. | 610 | 5.5 | 489 | 0 |
| 2. | 582 | 5.6 | 534 | 0 |
| 3. | 590 | 5.7 | 530 | 0 |
| 4. | 595 | 5.6 | 517 | 0 |

TABLE 8

| | | | |
|---|---|---|---|
| | | Fuel | 50:50 |
| Total Rating kW | 100 | Fuel Rate | 34.89 |
| Reburn % | 30 | Fuel Setting | 39.5 |
| Primary ϕ | .95 | Primary Air $O_2$ % | .96 |
| Reburn ϕ | 1.05(.409) | Reburn Air $O_2$ % | 4.75 |

| # | NO Before | $O_2$ Before | NO Reburn | $O_2$ Reburn |
|---|---|---|---|---|
| 1. | 599 | 4.8 | 274 | 0 |
| 2. | 607 | 4.7 | 245 | 0 |
| 3. | 592 | 4.7 | 216 | 0 |
| 4. | 593 | 4.6 | 219 | 0 |

TABLE 9

| | | | |
|---|---|---|---|
| | | Fuel | 50:50 |
| Total Rating kW | 100 | Fuel Rate | 34.89 |
| Reburn % | 30 | Fuel Setting | 39.5 |
| Primary ϕ | .95 | Primary Air $O_2$ % | .96 |
| Reburn ϕ | 1.05 | Reburn Air $O_2$ % | 5.0 |

| # | NO Before | $O_2$ Before | NO Reburn | $O_2$ Reburn |
|---|---|---|---|---|
| 1. | 693 | 4.9 | 295 | 0 |
| 2. | 605 | 4.9 | 277 | 0 |
| 3. | 583 | 4.9 | 278 | 0 |
| 4. | 601 | 4.9 | 253 | 0 |

TABLE 10

| | | | |
|---|---|---|---|
| | | Fuel | 50:50 |
| Total Rating kW | 100 | Fuel Rate | 34.89 |
| Reburn % | 30 | Fuel Setting | 39.5 |
| Primary ϕ | .95 | Primary Air $O_2$ % | .96 |
| Reburn ϕ | 1 | Reburn Air $O_2$ % | 5.6 |

| # | NO Before | $O_2$ Before | NO Reburn | $O_2$ Reburn |
|---|---|---|---|---|
| 1. | 605 | 5.6 | 337 | 0 |
| 2. | 590 | 5.6 | 341 | 0 |
| 3. | 597 | 5.5 | 345 | 0 |
| 4. | 593 | 5.6 | | |

TABLE 11

| | | | |
|---|---|---|---|
| | | Fuel | 50:50 |
| Total Rating kW | 100 | Fuel Rate | 34.89 |
| Reburn % | 30 | Fuel Setting | 39.5 |
| Primary ϕ | .95 | Primary Air $O_2$ % | .96 |
| Reburn ϕ | 1.1 | Reburn Air $O_2$ % | 4.3 |

| # | NO Before | $O_2$ Before | NO Reburn | $O_2$ Reburn |
|---|---|---|---|---|
| 1. | 595 | 4.3 | 260 | 0 |
| 2. | 596 | 4.3 | 240 | 0 |
| 3. | 591 | 4.3 | 227 | 0 |
| 4. | 580 | 4.3 | 206 | 0 |

TABLE 12

| | | | |
|---|---|---|---|
| | | Fuel | 90:10 |
| Total Rating kW | 100 | Fuel Rate | 24.23 |
| Reburn % | 30 | Fuel Setting | 39.5 |
| Primary ϕ | .95 | Primary Air $O_2$ % | .96 |
| Reburn ϕ | 1.05 (.34) | Reburn Air $O_2$ % | 5.0 |

| # | NO Before | $O_2$ Before | NO Reburn | $O_2$ Reburn |
|---|---|---|---|---|
| 1. | 608 | 5.0 | 387 | 0 |
| 2. | 594 | 5.0 | 336 | 0 |
| 3. | 582 | 5.0 | 346 | 0 |
| 4. | 593 | 4.9 | 324 | 0 |

TABLE 13

| | | | |
|---|---|---|---|
| | | Fuel | 90:10 |
| Total Rating kW | 100 | Fuel Rate | 24.23 |
| Reburn % | 30 | Fuel Setting | 39.5 |
| Primary ϕ | .95 | Primary Air $O_2$ % | .96 |
| Reburn ϕ | 1.0 | Reburn Air $O_2$ % | 5.66 |

| # | NO Before | $O_2$ Before | NO Reburn | $O_2$ Reburn |
|---|---|---|---|---|
| 1. | 597 | 5.5 | 490 | 0 |
| 2. | 590 | 5.5 | 506 | 0 |
| 3. | 589 | 5.5 | 493 | 0 |
| 4. | 584 | 5.6 | 488 | 0 |

TABLE 14

| | | | |
|---|---|---|---|
| | | Fuel | Manure |
| Total Rating kW | 100 | Fuel Rate | 39.5 |
| Reburn % | 30 | Fuel Setting | 57.31 |
| Primary ϕ | 1.05 | Primary Air $O_2$ % | .96 |
| Reburn ϕ | 1.0 | Reburn Air $O_2$ % | 5.6 |

| # | NO Before | $O_2$ Before | NO Reburn | $O_2$ Reburn |
|---|---|---|---|---|
| 1. | 612 | 5.6 | 146 | 0 |
| 2. | 588 | 5.5 | 139 | 0 |
| 3. | 580 | 5.6 | 146 | 0 |
| 4. | 605 | 5.5 | 149 | 0 |

TABLE 15

| | | | |
|---|---|---|---|
| | | Fuel | Manure |
| Total Rating kW | 100 | | 57.31 |
| Reburn % | 30 | Fuel Setting | 39.5 |
| Primary ϕ | 1.05 | Primary Air $O_2$ % | .96 |
| Reburn ϕ | 1.05 | Reburn Air $O_2$ % | 4.9 |

| # | NO Before | $O_2$ Before | NO Reburn | $O_2$ Reburn |
|---|---|---|---|---|
| 1. | 595 | 4.9 | 123 | 0 |
| 2. | 603 | 4.9 | 123 | 0 |
| 3. | 600 | 4.8 | 121 | 0 |
| 4. | 599 | 5.0 | 123 | 0 |

TABLE 16

| | | Fuel | Manure |
|---|---|---|---|
| Total Rating kW | 100 | Fuel Rate | 57.31 |
| Reburn % | 30 | Fuel Setting | 39.5 |
| Primary ϕ | 1.05 | Primary Air $O_2$ % | .96 |
| Reburn ϕ | 1.1 | Reburn Air $O_2$ % | 4.1 |

| # | NO Before | $O_2$ Before | NO Reburn | $O_2$ Reburn |
|---|---|---|---|---|
| 1. | 585 | 4.1 | 151 | 0 |
| 2. | 604 | 4.1 | 182 | 0 |
| 3. | 591 | 4.2 | 169 | 0 |
| 4. | 589 | 4.0 | 162 | 0 |

TABLE 17

| | | Fuel | Chicken |
|---|---|---|---|
| Total Rating kW | 100 | Fuel Rate | 44.76 |
| Reburn % | 30 | Fuel Setting | 39.5 |
| Primary ϕ | .96 | Primary Air $O_2$ % | .96 |
| Reburn ϕ | 1.0 | Reburn Air $O_2$ % | 5.4 |

| # | NO Before | $O_2$ Before | NO Reburn | $O_2$ Reburn |
|---|---|---|---|---|
| 1. | 590 | 5.4 | 131 | 0 |
| 2. | 598 | 5.3 | 148 | 0 |
| 3. | 604 | 5.3 | 163 | 0 |
| 4. | 596 | 5.3 | 174 | 0 |

TABLE 18

| | | Fuel | Chicken |
|---|---|---|---|
| Total Rating kW | 100 | Fuel Rate | 44.76 |
| Reburn % | 30 | Fuel Setting | 39.5 |
| Primary ϕ | .95 | Primary Air $O_2$ % | .96 |
| Reburn ϕ | 1.15 (25) | Reburn Air $O_2$ % | .40 |

| # | NO Before | $O_2$ Before | NO Reburn | $O_2$ Reburn |
|---|---|---|---|---|
| 1. | 610 | 3.9 | 112 | 0 |
| 2. | 615 | 4.0 | 138 | 0 |
| 3. | 580 | 4.0 | 84 | 0 |
| 4. | 616 | 4.0 | 74 | 0 |

TABLE 19

| | | Fuel | Chicken |
|---|---|---|---|
| Total Rating kW | 100 | Fuel Rate | 44.76 |
| Reburn % | 30 | Fuel Setting | 39.52 |
| Primary ϕ | .95 | Primary Air $O_2$ % | .96 |
| Reburn ϕ | 1.05 (.309) | Reburn Air $O_2$ % | 4.66 |

| # | NO Before | $O_2$ Before | NO Reburn | $O_2$ Reburn |
|---|---|---|---|---|
| 1. | 590 | 4.7 | 141 | 0 |
| 2. | 585 | 4.7 | 144 | 0 |
| 3. | 585 | 4.5 | 134 | 0 |
| 4. | 588 | 4.6 | 137 | 0 |

TABLE 20

| | | Fuel | Manure |
|---|---|---|---|
| Total Rating kW | 100 | Fuel Rate | 57.31 |
| Reburn % | 30 | Fuel Setting | 39.5 |
| Primary ϕ | 1.05 | Primary Air $O_2$ % | .96 |

TABLE 20-continued

| | | | |
|---|---|---|---|
| Reburn ϕ | 1.0 (.39) | Reburn Air $O_2$ % | 5.6 |
| Primary Air | 803 | | |
| Reburn Air | 260 | | |

| # | NO Before | $O_2$ Before | NO Reburn | $O_2$ Reburn |
|---|---|---|---|---|
| 1. | 587 | 5.65 | 121 | 0 |
| 2. | 590 | 5.55 | 118 | 0 |
| 3. | 586 | 5.56 | 104 | 0 |
| 4. | 590 | 5.54 | 97 | 0 |

TABLE 21

| | | Fuel | Coal |
|---|---|---|---|
| Total Rating kW | 100 | Fuel Rate | |
| Reburn % | 30 | Fuel Setting | 39.5 |
| Primary ϕ | .95 | Primary Air $O_2$ % | .96 |
| Reburn ϕ | 1 (.40) | Reburn Air $O_2$ % | 5.6 |
| Primary Air | 803 | | |
| Reburn Air | 268 | | |

| # | NO Before | $O_2$ Before | NO Reburn | $O_2$ Reburn |
|---|---|---|---|---|
| 1. | 603 | 5.71 | 505 | .72 |
| 2. | 617 | 5.68 | 530 | .7 |
| 3. | 578 | 5.67 | 520 | .6 |
| 4. | 614 | 5.59 | 535 | .6 |
| 5. | 600 | 5.76 | 430 | .47 |

TABLE 22

| | | Fuel | Coal |
|---|---|---|---|
| Total Rating kW | 100 | Fuel Rate | 22.77 |
| Reburn % | 30 | Fuel Setting | 39.52 |
| Primary ϕ | .95 | Primary Air $O_2$ % | .96 |
| Reburn ϕ | 1.1 | Reburn Air $O_2$ % | 4.3 |
| Primary Air | 803 | Primary Δh | 3 |
| Reburn Air | 171 | Reburn Gauge | 112 |
| Actual Primary Setting | 3.5 | Reburn Setting | 95 |

| # | NO Before | $O_2$ Before | NO Reburn | $O_2$ Reburn | NO After | $O_2$ After |
|---|---|---|---|---|---|---|
| 1. | 605 | 4.4 | 395 | .2 | 555 | 4.67 |
| 2. | 580 | 4.14 | 385 | .23 | 513 | 4.3 |
| 3. | 588 | 4.37 | 316 | .22 | 570 | 3.95 |
| 4. | 603 | 4.28 | 363 | .19 | 550 | 4.51 |

TABLE 23

| | | Fuel | Manure |
|---|---|---|---|
| Total Rating kW | 100 | Fuel Rate | 39.52 |
| Reburn % | 30 | Fuel Setting | 57.31 |
| Primary ϕ | .95 | Primary Air $O_2$ % | .96 |
| Reburn ϕ | 1.1 | Reburn Air $O_2$ % | 4.1 |
| Primary Air | 803 | | |
| Reburn Air | 163 | | |

| # | NO Before | $O_2$ Before | NO Reburn | $O_2$ Reburn |
|---|---|---|---|---|
| 1. | 607 | 4.2 | 122 | 0 |
| 2. | 616 | 4.08 | 118 | 0 |
| 3. | 595 | 4.1 | 131 | 0 |
| 4. | 596 | 4.0 | 152 | 0 |

TABLE 24

| | | | |
|---|---|---|---|
| | | Fuel | Manure |
| Total Rating kW | 100 | Fuel Rate | 57.31 |
| Reburn % | 30 | Fuel Setting | 39.52 |
| Primary ϕ | .95 (.526) | Primary Air $O_2$ % | .96 |
| Reburn ϕ | 1.05 (.33) | Reburn Air $O_2$ % | 4.9% |
| Primary Air | 803 | | |
| Reburn Air | 209 | | |

| # | NO Before | $O_2$ Before | NO Reburn | $O_2$ Reburn |
|---|---|---|---|---|
| 1. | 593 | 5.01 | 143 | 0 |
| 2. | 594 | 4.96 | 166 | 0 |
| 3. | 609 | 4.88 | 170 | 0 |
| 4. | 590 | 4.80 | 169 | 0 |

TABLE 25

| | | | |
|---|---|---|---|
| | | Fuel | Coal |
| Total Rating kW | 100 | Fuel Rate | 22.77 |
| Reburn % | 30 | Fuel Setting | 39.5 |
| Primary ϕ | .95 (5.2%) | Primary Air $O_2$ % | .96% |
| Reburn ϕ | 1.05 (33%) | Reburn Air $O_2$ % | 4.9% |
| Primary Air | 803 | | |
| Reburn Air | 217 | | |

| # | NO Before | $O_2$ Before | NO Reburn | $O_2$ Reburn |
|---|---|---|---|---|
| 1. | 614 | 5.01 | 427 | .35 |
| 2. | 580 | 5.00 | 430 | .35 |
| 3. | 580 | 5.00 | 400 | .30 |
| 4. | 585 | 5.08 | 432 | .35 |

TABLE 26

| | | | |
|---|---|---|---|
| | | Fuel | Coal |
| Total Rating kW | 100 | Fuel Rate | 22.77 |
| Reburn % | 30 | Fuel Setting | 39.52 |
| Primary ϕ | .975 (2.6) | Primary Air $O_2$ % | .49 |
| Reburn ϕ | 1.15 (22%) | Reburn Air $O_2$ % | 3.5 |
| Primary Air | 783 | | |
| Reburn Air | 149 | | |

| # | NO Before | $O_2$ Before | NO Reburn | $O_2$ Reburn | NO After | $O^2$ After |
|---|---|---|---|---|---|---|
| 1. | 598 | 360 | 360 | .07 | 580 | 3.70 |
| 2. | 590 | 340 | 290 | .09 | 592 | 3.6(6) |
| 3. | 592 | 3.66 | 296 | .30 | | |
| 4. | 610 | 3.55 | 416 | .25 | 600 | 3.70 |
| 5. | 598 | 3.47 | | | | |

Although only exemplary embodiments of the invention are specifically described above, it will be appreciated that modifications and variations of the invention are possible without departing from the spirit and intended scope of the invention.

REFERENCES

The following references are incorporated by reference herein.

[1] DOE, Reburning Technologies for the Control of Nitrogen Oxides Emissions from Coal-Fired Boilers, TOPICAL REPORT NUMBER 14 MAY 1999. TOPICAL REPORT NUMBER 14, The U.S. Department of Energy, MAY 1999.

[2] Liu, H., Gibbs, B. M., and Hampartsoumian, "The Significance of Reburning Coal Rank on the Reduction of NO in drop tube furnace," 8th Int. Symp. On Transport Phenomena in Combustion, San Francisco, Calif., 1995.

[3] Frazzitta S. Annamalai K., and Sweeten J., "Performance of a Burner with Coal and Coal: Feedlot manure Blends," Journal of Propulsion and Power—special issue—Terrestrial Energy, 15, no: 2, 181–186, (1999).

We claim:

1. A method of reducing the amount of $NO_x$ resulting from the combustion of fuel comprising:

combusting a first fuel in a first combustion to produce air containing $NO_x$;

providing the air containing $NO_x$ to a second combustions;

combusting a reburn fuel in the second combustion;

wherein the reburn fuel includes at least 10% feedlot biomass in the form of a fine powder and coal; and wherein the second combustion reduces the level of $NO_x$ in the air from the first combustion by at least 40%.

2. The method of claim 1, wherein said reburn fuel contains less than approximately 45% ash.

3. The method of claim 1, wherein said reburn fuel contains less than approximately 20% ash.

4. The method of claim 1, wherein said first fuel is coal or natural gas.

5. The method of claim 1, wherein said feedlot biomass includes manure from at least one animal of the group consisting of: beef, swine, horses and poultry.

6. The method of claim 1, wherein the first and second fuels are combusted in a boiler burner.

7. The method of claim 1, wherein said first fuel is combusted in at least one first burner and said second fuel is combusted in a second burner, wherein said first and second burner are part of a multiple-burner boiler unit.

8. The method of claim 1, wherein said reburn fuel contains at least 90% feedlot biomass.

9. The method of claim 1, wherein said reburn fuel contains at least 50% feedlot biomass.

10. The boiler unit of claim 1, wherein said reburn fuel contains at least 90% feedlot biomass.

11. The boiler unit of claim 1, wherein said reburn fuel contains at least 50% feedlot biomass.

12. A boiler burner for combustion of fuel comprising:

a blower to direct air flow;

a first burner, wherein the first burner produces gases containing $NO_x$;

an injection point for a reburn fuel; and an exhaust;

wherein the blower directs gases containing $NO_x$ from the first burner to flow past the injection point for the reburn fuel to the exhaust;

wherein said reburn fuel includes at least 10% feedlot biomass in the form of a fine powder and coal; and wherein the level of $NO_x$ in gasses leaving the exhaust contains at least 40% less $NO_x$ than gasses produced by the first burner.

13. The boiler burner of claim 12, wherein the reburn fuel contains less than approximately 45% ash.

14. The boiler burner of claim 12, wherein the reburn fuel contains less than approximately 20% ash.

15. The burner boiler of claim 12, wherein said reburn fuel contains at least 90% feedlot biomass.

16. The burner boiler of claim 12, wherein said reburn fuel contains at least 50% feedlot biomass.

17. A multiple-burner boiler unit for combustion comprising:

a furnace containing furnace gases;

at least one first burner, wherein the first burner combusts a first fuel and produces furnace gasses containing $NO_x$;

at least one second burner, wherein the second burner combusts a reburn fuel and reduces $NO_x$ in the furnace gasses produced by the first burner by at least 40%, wherein said reburn fuel includes at least 10% feedlot biomass in the form of a fine powder and coal.

18. The boiler unit of claim 17, where the reburn fuel contains less than approximately 45% ash.

19. The boiler unit of claim 17, wherein the reburn fuel contains less than approximately 20% ash.

20. The boiler unit of claim 17, wherein said first fuel is coal or natural gas.

* * * * *